US006722588B1

(12) United States Patent
Elkas

(10) Patent No.: US 6,722,588 B1
(45) Date of Patent: Apr. 20, 2004

(54) FOG NOZZLE WITH JEWELED ORIFICE

(75) Inventor: Michael V. Elkas, Ramsey, NJ (US)

(73) Assignee: Atomizing Systems, Inc., Ho-Ho-Kus, NJ (US)

( * ) Notice: Subject to any disclaimer, the term of this patent is extended or adjusted under 35 U.S.C. 154(b) by 0 days.

(21) Appl. No.: 10/410,553

(22) Filed: Apr. 9, 2003

(51) Int. Cl.[7] ..... B05B 1/00

(52) U.S. Cl. ..... 239/596; 239/505; 239/507; 239/512; 239/518; 239/589; 239/DIG. 19

(58) Field of Search ..... 239/505, 507, 239/512, 518, 589, 596, DIG. 19

(56) References Cited

U.S. PATENT DOCUMENTS

| | | | | |
|---|---|---|---|---|
| 921,205 A | | 5/1909 | Cramer | |
| 1,761,422 A | | 6/1930 | Wagner | |
| 1,940,171 A | | 12/1933 | Huss | |
| 2,009,932 A | | 7/1935 | Klotzman | |
| 2,540,663 A | | 2/1951 | Garey | |
| 2,701,165 A | | 2/1955 | Bete et al. | |
| 3,606,159 A | | 9/1971 | Sutton | |
| 3,823,408 A | * | 7/1974 | Gordon, III | 239/601 |
| 3,894,691 A | | 7/1975 | Mee | |
| 4,150,794 A | | 4/1979 | Higgins | |
| 4,244,521 A | | 1/1981 | Guse | |
| 4,869,430 A | | 9/1989 | Good | |
| 4,990,290 A | | 2/1991 | Gill et al. | |
| 5,033,681 A | | 7/1991 | Munoz | |
| 5,224,653 A | * | 7/1993 | Nelson et al. | 239/222.17 |
| 5,240,648 A | | 8/1993 | Gill et al. | |
| 5,620,142 A | | 4/1997 | Elkas | |
| 5,893,520 A | | 4/1999 | Elkas | |
| 6,302,960 B1 | * | 10/2001 | Baroudi et al. | 239/596 |

FOREIGN PATENT DOCUMENTS

| | | |
|---|---|---|
| FR | 540399 | 8/1955 |
| GB | 1 376 591 | 12/1974 |
| JP | 2-26611 | 1/1990 |

* cited by examiner

*Primary Examiner*—Robin O. Evans
(74) *Attorney, Agent, or Firm*—Akin Gump Strauss Hauer & Feld, L.L.P.

(57) ABSTRACT

A pin jet nozzle for providing an evaporative fog in evaporative cooling systems or the like has a body member with an internal bore for receiving fluid under pressure, and an orifice receiving chamber integrally formed in the upper surface of the body member. The orifice receiving chamber is unitary with the body member and in fluid communication with the internal bore. An orifice member is directly secured in the orifice receiving chamber so that an orifice of the orifice member is coaxial with the internal bore. A pin member has an impingement pin with an impingement face that is spaced from, and in alignment with, the orifice.

17 Claims, 3 Drawing Sheets

FOG NOZZLE WITH JEWELED ORIFICE

BACKGROUND OF THE INVENTION

This invention relates to nozzles, and more particularly to pin-jet nozzles capable of producing fog in evaporative cooling systems and the like.

Evaporative cooling systems have been employed in various applications for a number of years. Such systems typically involve a pressurized fluid, usually water, escaping through a small orifice and impinging on a proximate surface. The force of the pressurized stream against the proximate surface causes the fluid to disperse into minute particles creating a localized fog. A fog differs from a mist, although the terms are often used imprecisely. As used herein, a fog contains small droplets which evaporate from the air rather than falling to cause a localized wetting. Fogs are typically used for cooling, and sometimes, for humidification. A mist, as used herein, contains larger particles which fall to create a localized wetting, and are typically used more for providing irrigation.

A pin-jet nozzle is typically used in a hydraulic system in which the water is pressurized to about 350 to over 1,000 pounds per square inch. At that pressure a thin, substantially-coherent stream of water is forced out through an orifice that is approximately six one-thousandths of an inch in diameter and against an external impingement pin, which is also about six one-thousandths of an inch in diameter, although it is common for larger size impingement pins to be employed. This creates droplets that are sufficiently small to be essentially unaffected by gravity because of their increased surface area in proportion to their volume. Water droplets of such small dimension evaporate in the air and therefore do not contribute to localized wetting and its consequent disadvantages, such as mildew, mold, and water damage. With the evaporation of each droplet, its heat of vaporization is removed from the ambient air, reducing the ambient air temperature. An array of 200 to 300 of these nozzles can cool a large area, including outdoor areas.

A suitable pin jet nozzle for producing fog is disclosed in U.S. Pat. No. 5,620,142 to Elkas, the disclosure of which is hereby incorporated by reference in its entirety. This patent teaches the use of an orifice member that is prepared from a ruby or sapphire wafer. An orifice is cut into the wafer and then wire polished to a tolerance (as small as 0.0002 inch) which is not possible with other techniques, such as drilling or extrusion. The wafer is then firmly held within a generally cylindrical insert member by standard metalworking techniques to expand a portion of the metal of the insert member over the surface of the orifice member. The insert member is then placed and secured into an orifice outlet of a nozzle body. Subsequently, an impingement pin is installed in alignment with the orifice. Although this fog nozzle was a vast improvement over the prior art, it has been found that the insert can deteriorate under acid cleaning. In addition, there is a possibility that leakage may occur between the mating surfaces of the insert member and the nozzle body. Accordingly, it is desirable to provide a fog nozzle that is less subject to deterioration and leakage than the prior art.

BRIEF SUMMARY OF THE INVENTION

According to one aspect of the invention, a pin jet nozzle for providing an evaporative fog with fluid particles having a diameter of less than fifty micrometers comprises a body member, a disk-shaped orifice member directly secured to the body member, and a pin member mounted to the body member. The body member has upper and lower surfaces, an internal bore for receiving fluid under pressure, and an orifice receiving chamber integrally formed in the upper surface of the body member. The internal bore extends along an axis of the body member from the lower surface toward the upper surface. The orifice receiving chamber is unitary with the body member and in fluid communication with the internal bore. The orifice member is directly secured in the orifice receiving chamber so that an orifice of the orifice member is coaxial with the internal bore. The term "disk-shaped" as used herein means a member that is larger in cross dimension than in thickness, and thus does not necessarily refer to a cylindrical member. The pin member has an impingement pin with an impingement face that is spaced from, and in alignment with, the orifice.

According to a further aspect of the invention, pin jet nozzle for providing an evaporative fog comprises a body member, a disk-shaped orifice member directly secured to the body member, and a pin member mounted to the body member. The body member has upper and lower surfaces, an internal bore for receiving fluid under pressure, with the internal bore extending along an axis of the body member from the lower surface toward the upper surface and including lower, intermediate and upper bore portions, the upper bore portion being smaller in diameter than the intermediate bore portion which is in turn smaller in diameter than the lower bore portion, and an orifice receiving chamber that is integrally formed in the upper surface of the body member. The orifice receiving chamber is unitary with the body member and intersects with the upper bore portion so that the orifice receiving chamber is in fluid communication with the internal bore. The orifice receiving chamber comprises a first annular wall portion that surrounds the orifice member and extends in a first direction from the upper surface of the body member and a second annular wall portion that extends in a second direction toward the axis of the body member from the first wall portion. The orifice member is directly secured in the orifice receiving chamber of the body member and sandwiched between the upper surface and the second wall portion. The orifice member includes an orifice that is coaxial with the internal bore and smaller in diameter than the upper bore portion. The pin member includes an impingement pin with an impingement face that is spaced from, and in alignment with, the orifice.

According to an even further aspect of the invention, a method of forming a pin jet nozzle comprises the steps of: providing a body member with upper and lower surfaces; forming an internal bore in the body member, the internal bore extending along an axis of the body member from the lower surface toward the upper surface; forming an orifice receiving chamber in the upper surface of the body member, the orifice receiving chamber being unitary with the body member and in fluid communication with the internal bore; providing an orifice member with an orifice; securing the orifice member directly in the orifice receiving chamber of the body member so that the orifice is coaxial with the internal bore; and securing a pin member to the body member, the pin member including an impingement pin with an impingement face that is spaced from, and in alignment with, the orifice.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
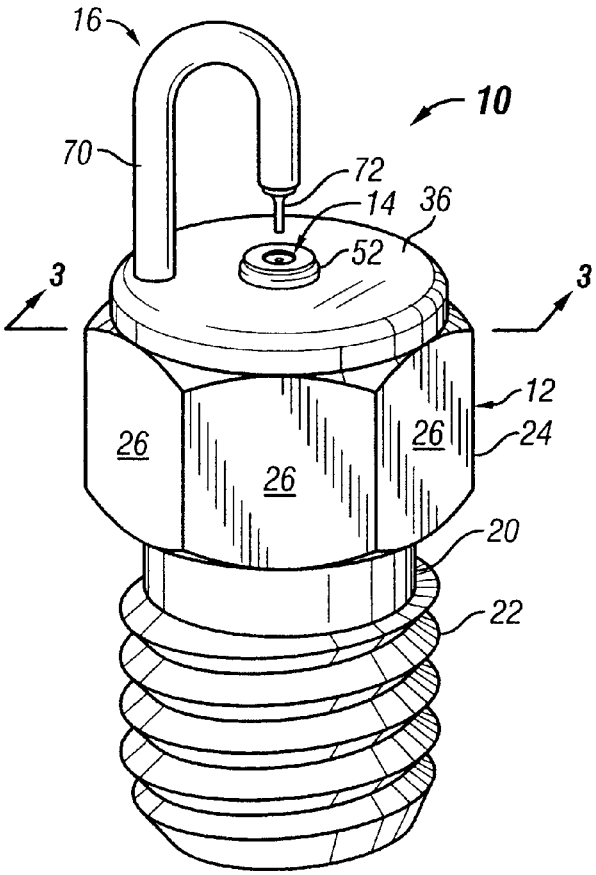
FIG. 1 is a perspective view of a pin jet nozzle in accordance with the present invention.

Referring to the drawings, and to FIG. 1 in particular, a pin jet nozzle 10 in accordance with the present invention is illustrated. The pin jet nozzle 10 includes a body member 12, an orifice member 14 fixedly mounted in the body member 12, and a pin member 16 mounted to the body member.

Figure 2:
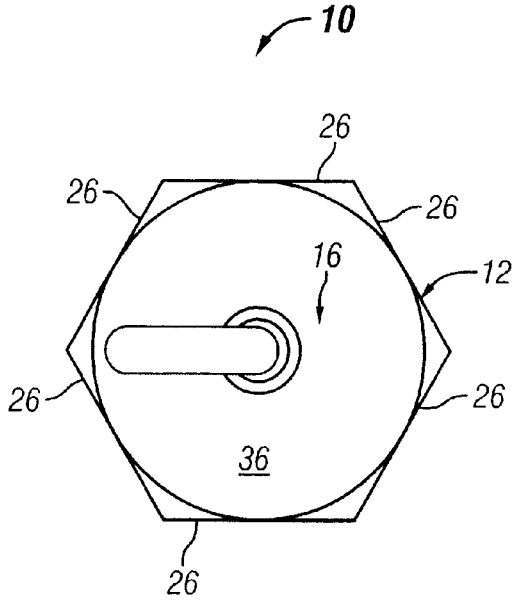
FIG. 2 is a top plan view of the pin jet nozzle of FIG. 1.

With additional reference to FIG. 2, the body member 12 is preferably constructed of nickel, silver, or stainless steel, but may be constructed of other suitable material or combination of materials. The body member 12 has a lower portion 20 with an external helical thread 22 and an upper portion 24 with flat faces 26 that can be engaged with a wrench or the like in a well-known manner for securing the pin jet nozzle 10 to a threaded opening of a pressurized hydraulic system (not shown). It will be understood that the pin jet nozzle 10 can be secured to the pressurized hydraulic system through other well-known securing means, such as welding, press-fitting, mutually engaging structure, and so on.

Figure 3:
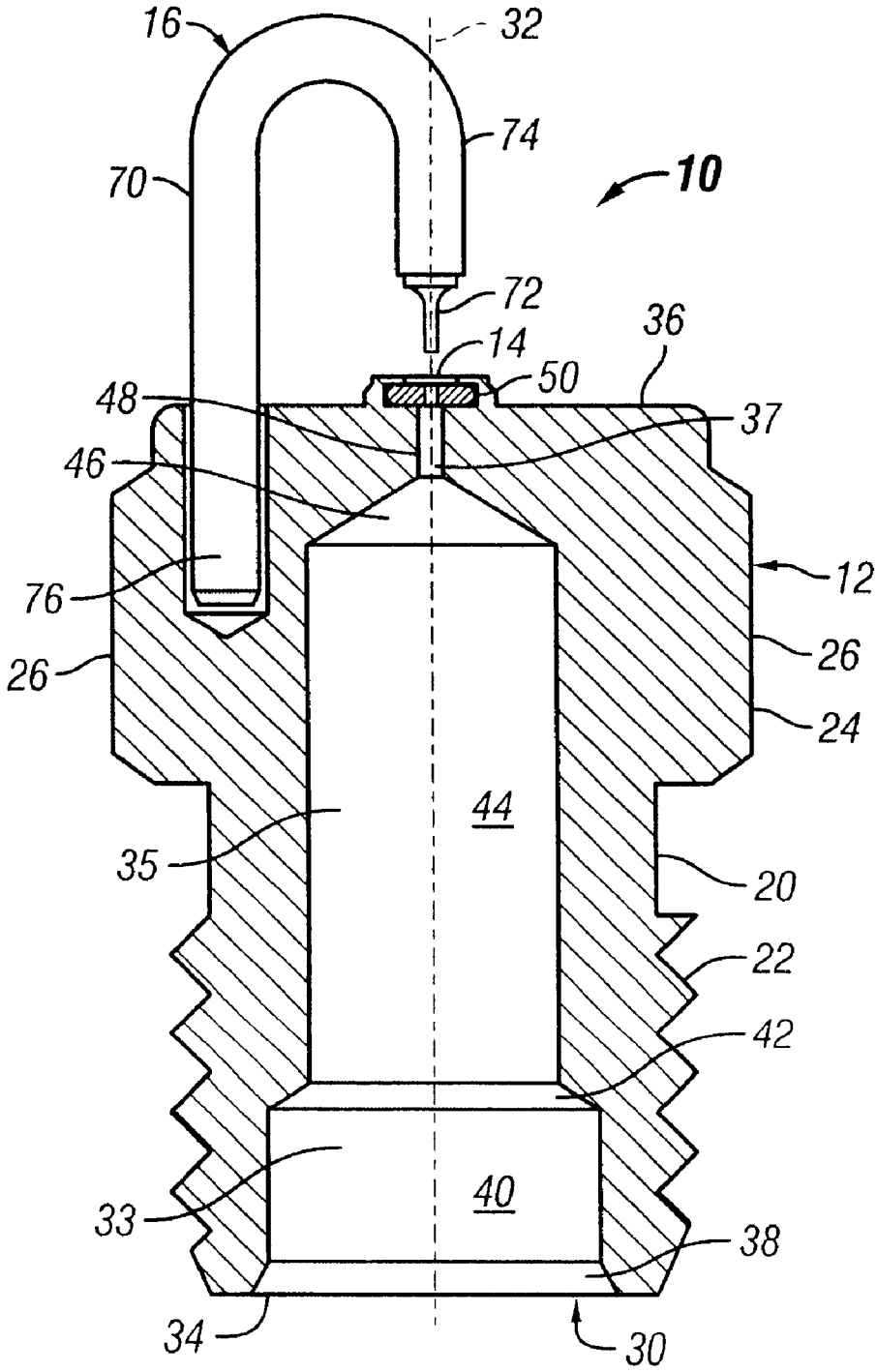
FIG. 3 is a sectional view of the pin jet nozzle taken along line 3—3 of FIG. 1.

As shown in FIG. 3, an internal chamber or bore 30 is formed in the body member 12 and is preferably concentric with a central axis 32 of the body member. The bore 30 preferably has lower, intermediate and upper bore portions 33, 35 and 37, respectively, that decrease in diameter in a step-wise fashion from the bottom surface 34 to the top surface 36 of the body member 12. The bore 30 is arranged for receiving fluid from the pressurized hydraulic system and preferably includes a first inner transitional frustro-conical surface 38 that extends generally upwardly and inwardly from the bottom surface 34 to the lower bore portion 33, a first inner circumferential surface 40 that defines the lower bore portion 33 and extends generally upwardly from the first transitional surface 38, a second inner transitional frustro-conical surface 42 that extends generally upwardly and inwardly from the first circumferential surface 40 to the intermediate bore portion 35, a second inner circumferential surface 44 that defines the intermediate bore portion 35 and extends generally upwardly from the second transitional surface 42, a third inner transitional frustro-conical surface 46 that extends generally upwardly and inwardly from the second circumferential surface 44 to the upper bore portion 37, and a third inner circumferential surface 48 that defines the upper bore portion 37 and extends upwardly to an orifice receiving chamber 50 from the third transitional surface 46. Although a particular configuration of the internal bore 30 has been shown and described, it will be understood that other bore configurations with more or less bore portions of different diameters, cross-dimensions, and/or cross sectional shapes can be provided.

Figure 4:
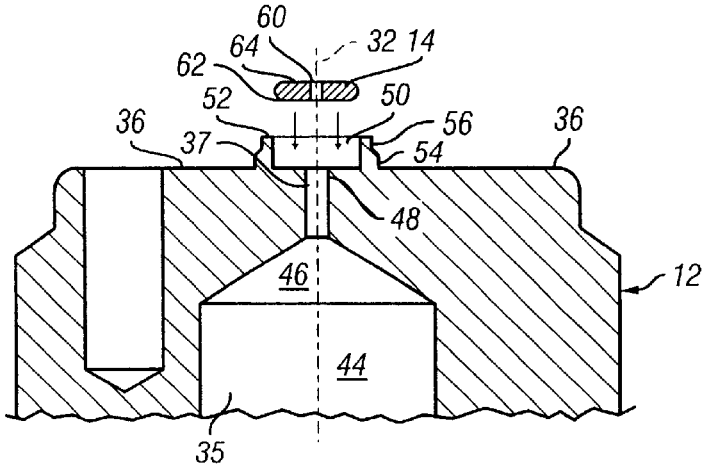
FIG. 4 is an enlarged sectional view of a nozzle body that forms part of the pin jet nozzle of FIG. 1.
Figure 5:
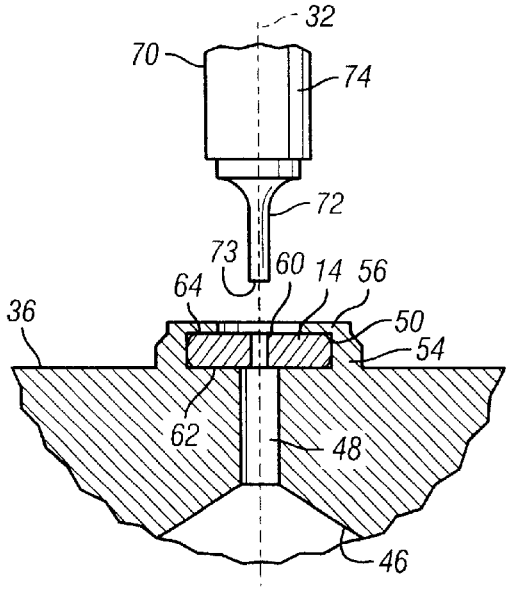
FIG. 5 is an enlarged sectional view of a portion of the pin jet nozzle.

With particular reference to FIGS. 4 and 5, an annular wall 52 extends upwardly from the upper surface 36 to define the orifice receiving chamber 50. The annular wall 52 includes a lower wall portion 54 that extends upwardly from the upper surface 36 and an upper wall portion 56 that initially extends upwardly from the lower wall portion 54, as shown in FIG. 4. Preferably, the upper wall portion is thinner than the lower wall portion so that it can be bent or otherwise deformed to extend inwardly toward the central axis 32 of the of the body member 12 and generally perpendicular to the lower wall portion 54, as best shown in FIG. 5. Prior to deformation of the upper wall portion 56, the orifice member 14 is inserted into the orifice receiving chamber 50. Once the upper wall portion 56 is deformed, the orifice member 54 is securely held within the orifice receiving chamber 50 and sandwiched between the upper wall portion 56 and the upper surface 36. Standard metalworking techniques can be used to deform the upper wall portion over the surface of the orifice member 14. The orifice member 14 should be held in a flat position, generally perpendicular to the central axis 32 of the body member 12. Other techniques for firmly securing or holding the orifice member 14 on or in the body member 12 can be employed.

The orifice member 14 is preferably constructed of wear-resistant material that can be formed to precise tolerances, such as artificial jewel material, including ruby and/or sapphire, or other suitable material. The outer shape of the orifice member 14 is not critical, but the flat disk illustrated is preferred for ease in locating the orifice member 14 in the orifice receiving chamber 50. An orifice 60 is formed in the orifice member 14, preferably at a center of the disk and extends from a lower surface 62 to an upper surface 64 thereof. When the orifice member 14 is installed in the body member 12, the orifice 60 is preferably in axial alignment with the central axis 32 and the upper bore portion 37 of the body member 12. The orifice member is constructed of the wear-resistant material to precise tolerances, including at least one surface which is smooth and polished with no surface pocketing, scarring, voids, or imperfections. The orifice 60 is precision-cut with a laser and then polished by wire polishing to a tolerance which is not possible with machining or extrusion technologies.

With reference to FIGS. 3 and 5, the pin member 16 of the nozzle 10 has a support post 70 and an impingement pin 72 connected at a terminal end 74 of the support post, as in the prior art. The support post is generally inverted J-shaped and has a mounting end 76 that is securely affixed onto or into the body member 12. The terminal end 74 of the support post is preferably aligned with the central axis 32 of the body member 12, with an impingement face 74 73 of the impingement pin 72 centered over the orifice 60. By virtue of the orifice size and tolerance, which define an exact output for each nozzle, the impingement pin 72 and the diameter of the impingement face 73 may be smaller in diameter than a comparable impingement pin of prior art pin jet nozzles. It has been common in the prior art to provide an impingement pin larger in diameter than the outlet orifice. As in the prior art, the impingement pin 73 is preferably axially positioned from the orifice 60 at a fixed distance. The exact dimension of the pin, its position and the geometry of its taper are believed to be within the knowledge of one skilled in the art.

The above-described arrangement of the present invention is capable of generating an evaporative fog with fluid particles that have a diameter of less than fifty micrometers. Further fluid input and output characteristics of the pin jet nozzle, as well as its use, are more fully disclosed in U.S. Pat. No. 5,620,142 to Elkas, the disclosure of which is hereby incorporated by reference in its entirety. Accordingly, the characteristics and use of the pin jet nozzle will not be further described.

By eliminating the prior art insert and mounting the orifice member 14 directly to the body member 12 in accordance with the present invention, deterioration of the insert under acid cleaning, as well as leakage between the insert and nozzle body are eliminated.

It will be understood that terms of orientation and/or position as used throughout the specification, such as top, bottom, upwardly, downwardly, inwardly, lower, intermediate, and upper, as well as their respective derivatives and equivalent terms, refer to relative rather than absolute orientations and/or positions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A pin jet nozzle for providing an evaporative fog with fluid particles having a diameter of less than fifty micrometers, the pin jet nozzle comprising:

a body member having upper and lower surfaces, an internal bore for receiving fluid under pressure, the internal bore extending along an axis of the body member from the lower surface toward the upper surface, and an orifice receiving chamber integrally formed in the upper surface of the body member, the orifice receiving chamber being unitary with the body member and in fluid communication with the internal bore;

a disk-shaped orifice member directly secured in the orifice receiving chamber of a body member, the orifice member including an orifice that is coaxial with the internal bore; and a pin member mounted to the body member, the pin member including an impingement pin with an impingement face that is spaced from, and in alignment with, the orifice;

wherein the orifice receiving chamber comprises a first wall portion that surrounds the orifice member and extends upwardly in a first direction from the upper surface of the body member; and wherein the orifice receiving chamber comprises a second wall portion that extends in a second direction toward the axis of the body member from the first wall portion.

2. A pin jet nozzle according to claim 1, wherein the orifice member is firmly secured between the upper surface of the body member and the second wall portion.

3. A pin jet nozzle according to claim 2, wherein the orifice member is constructed of an artificial jewel material.

4. A pin jet nozzle according to claim 2, wherein the first wall portion is thicker than the second wall portion.

5. A pin jet nozzle according to claim 4, wherein the second wall portion is deformed from the first direction to the second direction.

6. A pin jet nozzle according to claim 5, wherein the second direction is substantially perpendicular to the first direction.

7. A pin jet nozzle according to claim 1, wherein the internal bore comprises lower, intermediate and upper bore portions, with the upper bore portion intersecting the orifice receiving chamber.

8. A pin jet nozzle according to claim 7, wherein the upper bore portion is smaller in diameter than the intermediate bore portion which is in turn smaller in diameter than the lower bore portion.

9. A pin jet nozzle according to claim 8, wherein the orifice is smaller in diameter than the upper bore portion.

10. A pin jet nozzle according to claim 8, wherein the internal bore further comprises generally frustro-conical transitional surfaces between the lower and intermediate bores and the intermediate and upper bores.

11. A pin jet nozzle for providing an evaporative fog, the pin jet nozzle comprising:

a body member having:

upper and lower surfaces;

an internal bore for receiving fluid under pressure, the internal bore extending along an axis of the body member from the lower surface toward the upper surface and including lower, intermediate and upper bore portions, the upper bore portion being smaller in diameter than the intermediate bore portion which is in turn smaller in diameter than the lower bore portion; and an orifice receiving chamber integrally formed in the upper surface of the body member, the orifice receiving chamber being unitary with the body member and intersecting with the upper bore portion so that the orifice receiving chamber is in fluid communication with the internal bore, the orifice receiving chamber comprising a first annular wall portion surrounding the orifice member and extending in a first direction from the upper surface of the body member and a second annular wall portion extending in a second direction toward the axis of the body member from the first wall portion;

a disk-shaped orifice member directly secured in the orifice receiving chamber of the body member and sandwiched between the upper surface and the second wall portion, the orifice member including an orifice that is coaxial with the internal bore and smaller in diameter than the upper bore portion; and a pin member mounted to the body member, the pin member including an impingement pin with an impingement face that is spaced from, and in alignment with, the orifice.

12. A pin jet nozzle according to claim 11, wherein the orifice member is constructed of an artificial jewel material.

13. A pin jet nozzle according to claim 11, wherein the first wall portion is thicker than the second wall portion.

14. A pin jet nozzle according to claim 13, wherein the second wall portion is deformed from the first direction to the second direction.

15. A pin jet nozzle according to claim 14, wherein the second direction is substantially perpendicular to the first direction.

16. A pin jet nozzle according to claim 11, wherein the internal bore further comprises generally frustro-conical transitional surfaces between the lower and intermediate bores and the intermediate and upper bores.

17. A method of forming a pin jet nozzle, the method comprising the steps of:

providing a body member with upper and lower surfaces;

forming an internal bore in the body member, the internal bore extending along an axis of the body member from the lower surface toward the upper surface;

forming an orifice receiving chamber in the upper surface of the body member, the orifice receiving chamber being unitary with the body member and in fluid communication with the internal bore;

providing a disk-shaped orifice member with an orifice;

securing the orifice member directly in the orifice receiving chamber of the body member so that the orifice is coaxial with the internal bore, the orifice receiving chamber having a first wall portion and a second wall portion, wherein the first wall portion surrounds the orifice member and extends upwardly in a first direction from the upper surface of the body member and the second wall portion extends in a second direction towards the axis of the body member from the first wall portion to secure the orifice member in the orifice receiving chamber; and securing a pin member to the body member, the pin member including an impingement pin with an impingement face that is spaced from, and in alignment with, the orifice.

* * * * *